US006575845B2

(12) United States Patent
Galloway et al.

(10) Patent No.: US 6,575,845 B2
(45) **Date of Patent: *Jun. 10, 2003**

(54) MULTIPLE MATERIAL GOLF CLUB HEAD

(75) Inventors: J. Andrew Galloway, Escondido, CA (US); Richard C. Helmstetter, Rancho Santa Fe, CA (US); Matthew T. Cackett, San Diego, CA (US); Alan Hocknell, Encinitas, CA (US); D. Clayton Evans, San Marcos, CA (US); Herbert Reyes, Laguna Niguel, CA (US); Garth W. Smith, Vista, CA (US); James M. Murphy, Oceanside, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/683,856

(22) Filed: Apr. 22, 2002

(65) Prior Publication Data

US 2002/0142859 A1 Oct. 3, 2002

Related U.S. Application Data

(63) Continuation-in-part of application No. 09/906,889, filed on Jul. 16, 2001, now Pat. No. 6,491,592, which is a continuation-in-part of application No. 09/431,982, filed on Nov. 1, 1999, now Pat. No. 6,354,962.

(51) Int. Cl.[7] ..... A63B 53/04

(52) U.S. Cl. ..... 473/329; 473/345; 473/349; 473/342

(58) Field of Search ..... 473/329, 324, 473/330, 342, 345, 349, 350

(56) References Cited

U.S. PATENT DOCUMENTS

| | | | | |
|---|---|---|---|---|
| 1,167,387 | A | | 1/1916 | Daniel |
| 1,638,916 | A | | 8/1927 | Butchart |
| 1,780,625 | A | | 11/1930 | Mattern |
| 2,750,194 | A | | 6/1956 | Clark |
| 3,692,306 | A | | 9/1972 | Glover |
| 3,897,066 | A | | 7/1975 | Belmont |
| 3,937,474 | A | | 2/1976 | Jepson et al. |
| 3,970,236 | A | | 7/1976 | Rogers |
| 3,975,023 | A | | 8/1976 | Inamori |
| 3,989,248 | A | | 11/1976 | Campau |
| 4,021,047 | A | * | 5/1977 | Mader ..... 473/345 |
| 4,398,965 | A | | 8/1983 | Campau |

(List continued on next page.)

OTHER PUBLICATIONS

Golf Digest, Dec. 1978.
Golf Digest, Jun. 1981.

*Primary Examiner*—Paul T. Sewell
*Assistant Examiner*—Tom P Duong
(74) *Attorney, Agent, or Firm*—Michael A. Catania

(57) ABSTRACT

A fairway wood type golf club having a club head with a major body and a minor body is disclosed herein. The major body is composed of a metal material and has a striking plate section, a return section, a sole section, a ribbon section and a ledge portion. The minor body is preferably composed of a composite material and has a crown section and a ribbon section. The striking plate section preferably has variable face thickness. The minor body is preferably attached by a liquid adhesive to the ledge section of the major body.

12 Claims, 7 Drawing Sheets

U.S. PATENT DOCUMENTS 4,568,088 A 2/1986 Kurahashi
4,872,685 A 10/1989 Sun
4,877,249 A 10/1989 Thompson
5,024,437 A 6/1991 Anderson
5,094,383 A 3/1992 Anderson
5,106,094 A * 4/1992 Desbiolles et al. ..... 473/342
5,163,682 A * 11/1992 Schmidt et al. ..... 473/332
5,193,811 A 3/1993 Okumoto et al.
5,255,918 A 10/1993 Anderson
5,261,663 A 11/1993 Anderson
5,261,664 A 11/1993 Anderson
5,282,624 A 2/1994 Viste
5,310,185 A 5/1994 Viollaz et al.
5,318,300 A * 6/1994 Schmidt et al. ..... 473/305
5,344,140 A 9/1994 Anderson
5,346,216 A 9/1994 Aizawa
5,377,986 A 1/1995 Viollaz et al.
5,398,935 A 3/1995 Katayama
5,410,798 A 5/1995 Lo
5,425,538 A 6/1995 Vincent et al.
5,464,210 A 11/1995 Davis et al.
5,474,296 A * 12/1995 Schmidt et al. ..... 473/346
5,499,814 A 3/1996 Lu
5,516,107 A 5/1996 Okumoto et al.
5,547,427 A 8/1996 Rigal et al.
5,570,886 A 11/1996 Rigal et al.
5,624,331 A 4/1997 Lo et al.
5,743,813 A 4/1998 Chen et al.
5,776,011 A 7/1998 Su et al.
5,830,084 A 11/1998 Kosmatka
5,863,261 A 1/1999 Eggiman
5,888,148 A 3/1999 Allen
6,010,411 A * 1/2000 Reyes ..... 473/345
6,048,278 A 4/2000 Meyer et al.
6,146,571 A 11/2000 Vincent et al.
6,149,534 A 11/2000 Peters et al.
6,152,833 A 11/2000 Werner et al.
6,165,081 A 12/2000 Chou
6,354,962 B1 * 3/2002 Galloway et al. ..... 473/342
6,368,234 B1 * 4/2002 Galloway ..... 473/349
6,386,990 B1 * 5/2002 Reyes et al. ..... 473/344
6,398,666 B1 * 6/2002 Evans et al. ..... 473/345
6,440,011 B1 * 8/2002 Hocknell et al. ..... 473/342
6,471,604 B2 * 10/2002 Hocknell et al. ..... 473/334
6,491,592 B2 * 12/2002 Cackett et al. ..... 473/342
2002/0187853 A1 12/2002 Beach et al.

* cited by examiner

MULTIPLE MATERIAL GOLF CLUB HEAD

CROSS REFERENCES TO RELATED APPLICATIONS

This application is a continuation-in-part application of U.S. patent application Ser. No. 09/906,889, filed on Jul. 16, 2001, now U.S. Pat. No. 6,491,592, which is a continuation-in-part of U.S. patent application Ser. No. 09/431,982, filed Nov. 1, 1999, now U.S. Pat. No. 6,354,962.

FEDERAL RESEARCH STATEMENT

[Not Applicable]

BACKGROUND OF THE INVENTION

1. Field of the Invention

The present invention relates to a golf club head with a major body composed of a metal material, and a minor body composed of a light-weight material. More specifically, the present invention relates to a golf club head with a major body composed of a metal material for a more efficient transfer of energy to a golf ball at impact, and a non-metallic minor body to control the mass distribution.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inch), as opposed to the small deformations of the metallic club face (0.025 to 0.050 inch). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Aizawa, U.S. Pat. No. 5,346,216 for a Golf Club Head, discloses a face plate having a curved ball hitting surface.

U.S. Pat. No. 6,146,571 to Vincent, et al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 and 5 mm in thickness.

U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

The Rules of Golf, established and interpreted by the United States Golf Association (USGA) and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

Although the prior art has disclosed many variations of multiple material club heads, the prior art has failed to provide a multiple material club head with a high moment of inertia and greater forgiveness for the typical golfer.

SUMMARY OF THE INVENTION

The present invention provides a golf club with a golf club head having a metal major body and a light-weight minor body in order to provide a golf club head with a high moment of inertia and greater forgiveness. The golf club heads are preferably fairway woods, having loft angles greater than thirteen degrees, and ranging up to approximately twenty-five degrees for an eleven wood.

One aspect of the present invention is a golf club head including a major body composed of a metal material and a minor body composed of a non-metal material. The major body has a striking plate section, a return section, a sole section, a ribbon section and a ledge section. The striking plate section has a thickness in the range of 0.010 inch to 0.250 inch. The return section has a thickness in the range of 0.010 inch to 0.200 inch. The minor body has a crown section and a ribbon section. The minor body is attached to the ledge section of the major body.

Yet another aspect of the present invention is a golf club including a golf club head and a shaft. The golf club head has a major body composed of a metal material and a minor body composed of a plurality of plies of pre-preg co-cured into a solid composite shell. The major body has a striking plate section, a return section, a sole section, a ribbon section and a ledge section. The minor body has a crown section and a ribbon section. The minor body is attached to the ledge section of the major body. The golf club has a loft angle greater than thirteen degrees. The moment of inertia of the golf club head about the Izz axis through the center of gravity is greater than 1900 grams-centimeter squared, and the moment of inertia about the Iyy axis through the center of gravity is greater than 1000 grams-centimeter squared.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
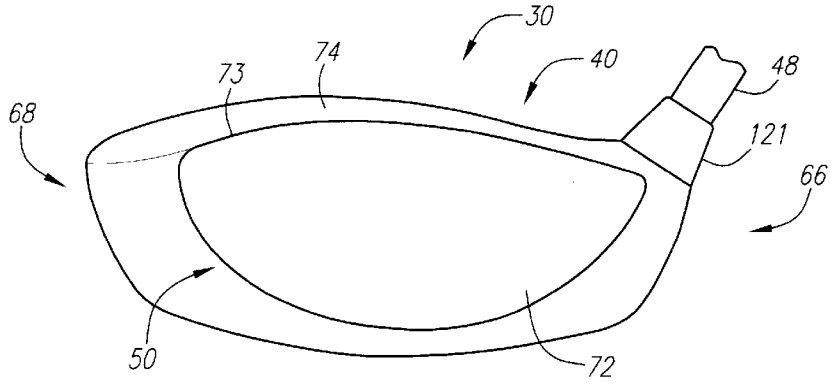
FIG. 1 is a front view of the golf club of the present invention.
Figure 2:
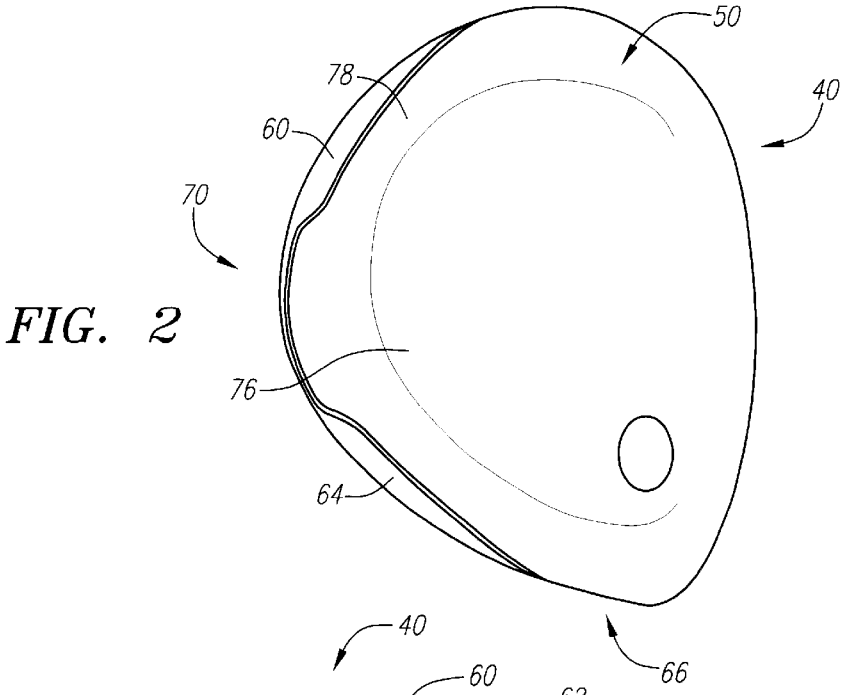
FIG. 2 is a bottom view of the golf club head of FIG. 1.
Figure 3:
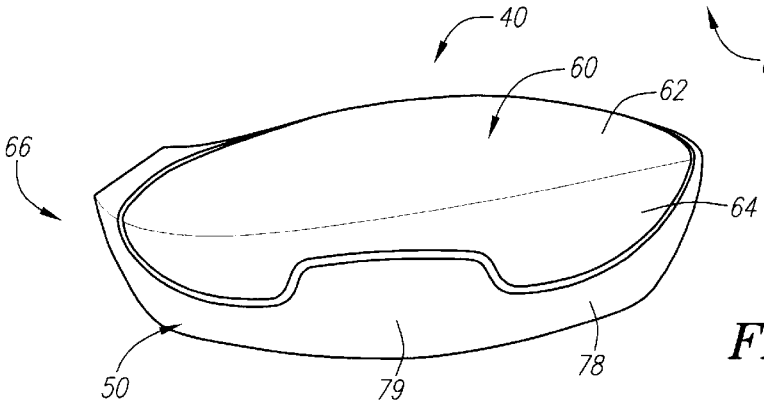
FIG. 3 is rear side view of the golf club head of FIG. 1.
Figure 4:
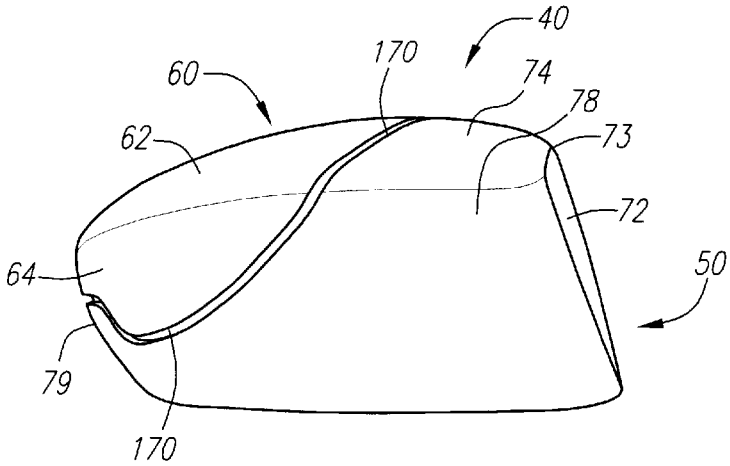
FIG. 4 is a toe side plan view of the golf club head of FIG. 1.
Figure 5:
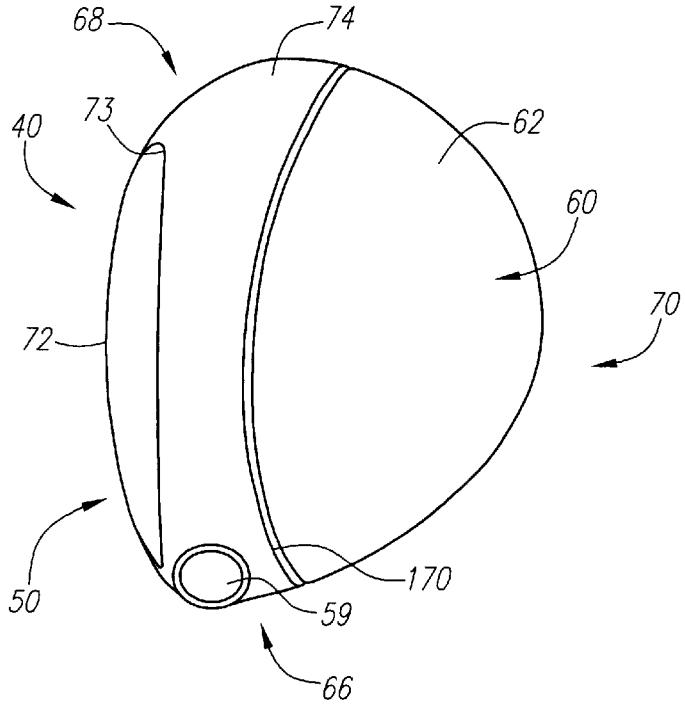
FIG. 5 is a top plan view of the golf club head of FIG. 1.
Figure 6:
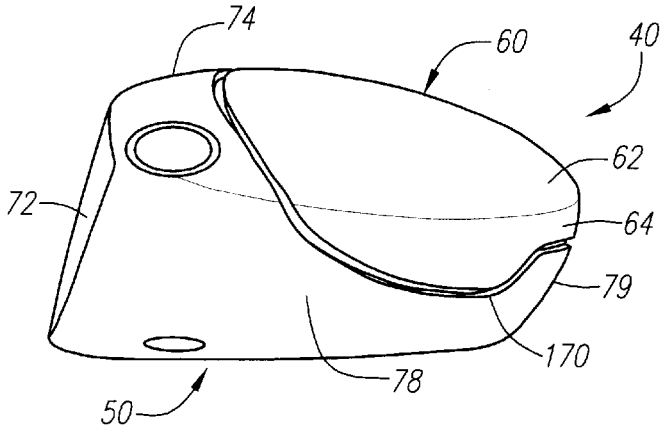
FIG. 6 is a heel side view of the golf club head of FIG. 1.
Figure 7:
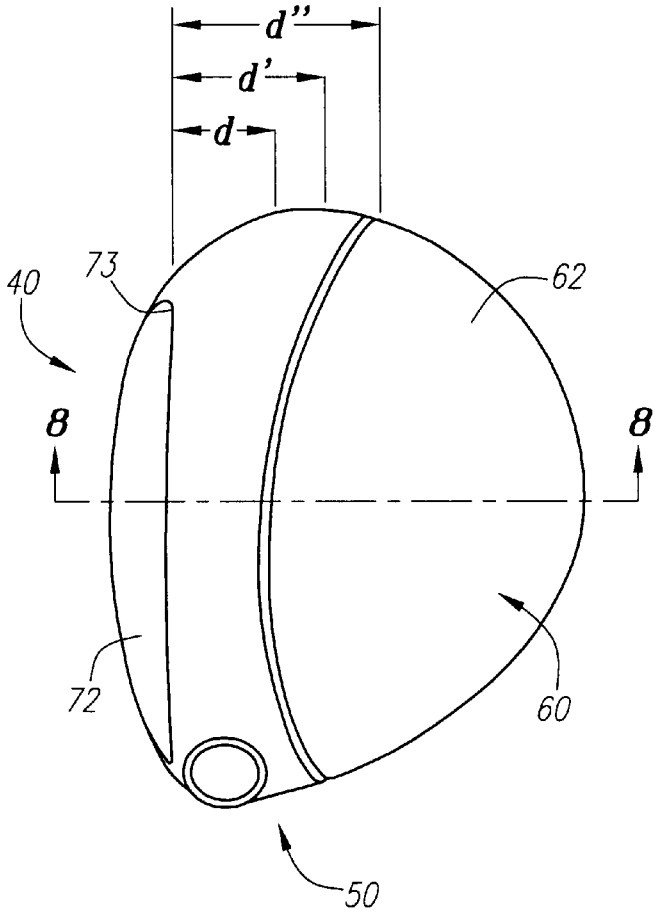
FIG. 7 is a top plan view of the golf club head of the present invention.

As shown in FIGS. 1–9, a golf club is generally designated 30. The golf club 30 has a golf club head 40 with a hollow interior, not shown. Engaging the club head 40 is a shaft 48 that has a grip, not shown, at a butt end and is inserted into a hosel 54 at a tip end.

The club head 40 is generally composed of two components, a major body 50 and minor body 60. The minor body 60 has a crown section 62 and a ribbon section 64. The club head 40 may also be partitioned into a heel end 66 nearest the shaft 48, a toe end 68 opposite the heel section 66, and an aft end 70.

The major body 50 is generally composed of a single piece of metal, and is preferably composed of a cast metal material. More preferably, the cast metal material is a stainless steel material or a titanium material such as pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Alternatively, the major body may be manufactured through forging, welding, forming, machining, powdered metal forming, metal-injection-molding, electro-chemical milling, and the like.

The major body 50 generally includes a striking plate section (also referred to herein as a face plate) 72, a return section 74 extending laterally rearward from the upper perimeter of the striking plate section 72, a sole section 76 extending laterally rearward from the striking plate section 72, a ribbon section 78 extending upward from the sole section 76, and a ledge section 80 stepped inward for attachment of the minor body 60. The striking plate section 72 typically has a plurality of scorelines thereon.

The return section 74 extends inward, towards the minor body 60, and has a general curvature from the heel end 66 to the toe end 68. The return section 74 has a length from the perimeter 73 of the striking plate section 72 tat is preferably a minimal length near the center of the striking plate section 72, and increases toward the toe end 68 and the heel end 66. A distanced represents the length of the return section 74 from the perimeter 73 at the center of the striking plate section 72, a distance d' from the perimeter 73 at the heel end 66 of the striking plate section 72, and a distance d" from the perimeter 73 at the toe end 68 of the striking plate section 72. In a preferred embodiment, the distance d ranges from 0.2 inch to 1.0 inch, more preferably 0.30 inch to 0.75 inch, and most preferably 0.60 inch for a 3-wood golf club head 40 and 0.35 inch for an eleven wood golf club head 40, as measured from the perimeter 73 of the striking plate section 72 to the rearward edge of the return section 74. In a preferred embodiment, the distance d' ranges from 0.4 inch to 1.25 inch, more preferably 0.50 inch to 0.100 inch, and most preferably 0.8 inch, as measured from the perimeter 73 of the striking plate section 72 to the rearward edge of the return section 74. In a preferred embodiment, the distance d" ranges from 0.4 inch to 1.25 inch, more preferably 0.50 inch to 0.100 inch, and most preferably 0.9 inch, as measured from the perimeter 73 of the striking plate section 72 to the rearward edge of the return section 74. The perimeter 73 of the striking plate section 72 is defined as the transition point where the major body 50 transitions from a plane substantially parallel to the striking plate section 72 to a plane substantially perpendicular to the striking plate section 72. Alternatively, one method for determining the transition point is to take a plane parallel to the striking plate section 72 and a plane perpendicular to the striking plate section 72, and then take a plane at an angle of forty-five degrees to the parallel plane and the perpendicular plane. Where the forty-five degrees plane contacts the major body 50 is the transition point thereby defining the perimeter 73 of the striking plate section 72.

The minor body 60 is preferably composed of a non-metal material, preferably a composite material such as continuous fiber pre-preg material (either thermosetting resin or thermoplastic resin). Other materials for the minor body 60 include other thermosetting materials or other thermoplastic materials such as injection molded plastics. The minor body 60 is preferably manufactured through bladder-molding, resin transfer molding, resin infusion, injection molding, compression molding, or a similar process. In a preferred process, the major body 50, with an adhesive on the exterior surface of the ledge section 80, is press-fitted with the minor body 60. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

Figure 8:
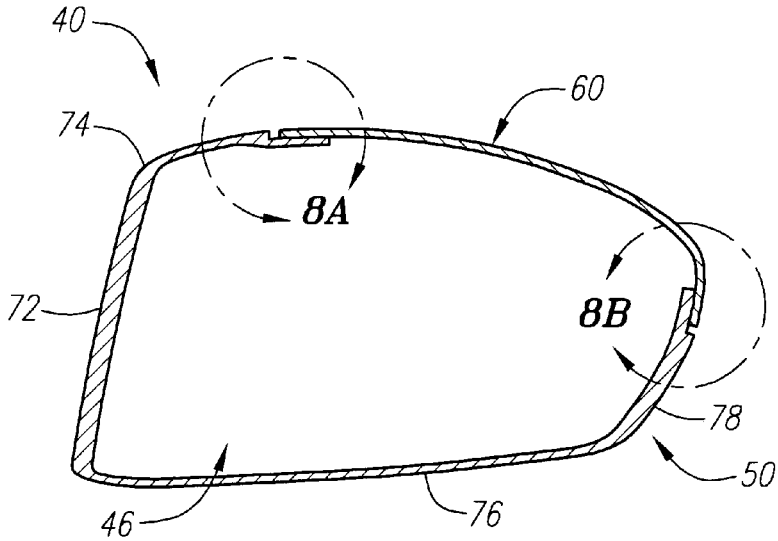
FIG. 8 is a cross-sectional view along line 8—8 of FIG. 7.
Figure 8A:
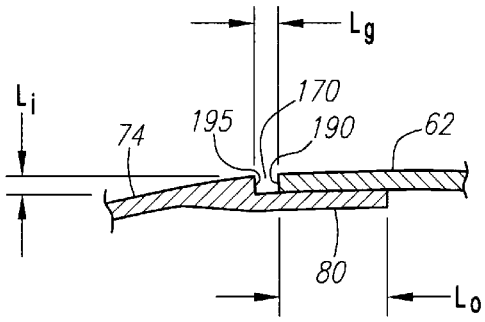
FIG. 8A is an isolated view of circle A of FIG. 8.
Figure 8B:
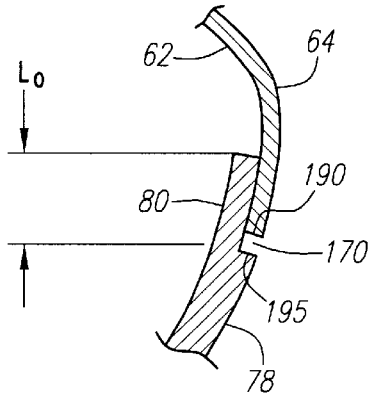
FIG. 8B is an isolated view of circle B of FIG. 8.

As shown specifically in FIGS. 8A and 8B, the minor body 60 overlaps the ledge section 80 a distance Lo, which preferably ranges from 0.10 inch to 1.00 inch, more preferably ranges from 0.40 inch to 0.70 inch, and is most preferably 0.50 inch. The ledge section 80 is preferably inward from the exterior surface of the major body 50 toward the hollow interior 46 a distance Li of 0.005 inch to 0.050 inch, more preferably 0.020 inch to 0.040 inch and most preferably 0.035 inch. The edge 195 of the major body 50 determines the inward distance Li of the ledge section 80. An annular gap 170 is created between an edge 190 of the minor body 60 and the edge 195 of the major body 50. The annular gap 170 has a distance Lg that preferably ranges from 0.020 inch to 0.100 inch, more preferably from 0.050 inch to 0.070 inch, and is most preferably 0.060 inch. An optional projection from an exterior surface of the ledge section 80 may establish a minimum bond thickness between the interior surface of the ledge section 80 and the overlapping portion of the minor body 60. The bond thickness preferably ranges from 0.002 inch to 0.100 inch, more preferably ranges from 0.005 inch to 0.040 inch, and is most preferably 0.0150 inch. A liquid adhesive preferably secures the minor body 60 to the ledge section 80 of the major body 50.

The crown section 62 of the minor body 60 is generally convex toward the sole section 76, and transitions into the ribbon section 64. The crown section 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The ribbon section 64 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch.

In a preferred embodiment, the minor body 60 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety.

The sole section 76 of the major body 50 is generally convex toward the crown section 62. The sole section 76 alternatively has a recess for attachment of a sole plate thereto. The sole plate is preferably attached with a pressure sensitive adhesive such as a polyethylene foam acrylic adhesive sold by the 3M company. The sole plate is preferably composed of a light weight metal such as aluminum, titanium or titanium alloy. Alternatively, the sole plate is composed of a durable plastic material. The sole plate may have graphics thereon for designation of the brand of club and loft.

Figure 9:
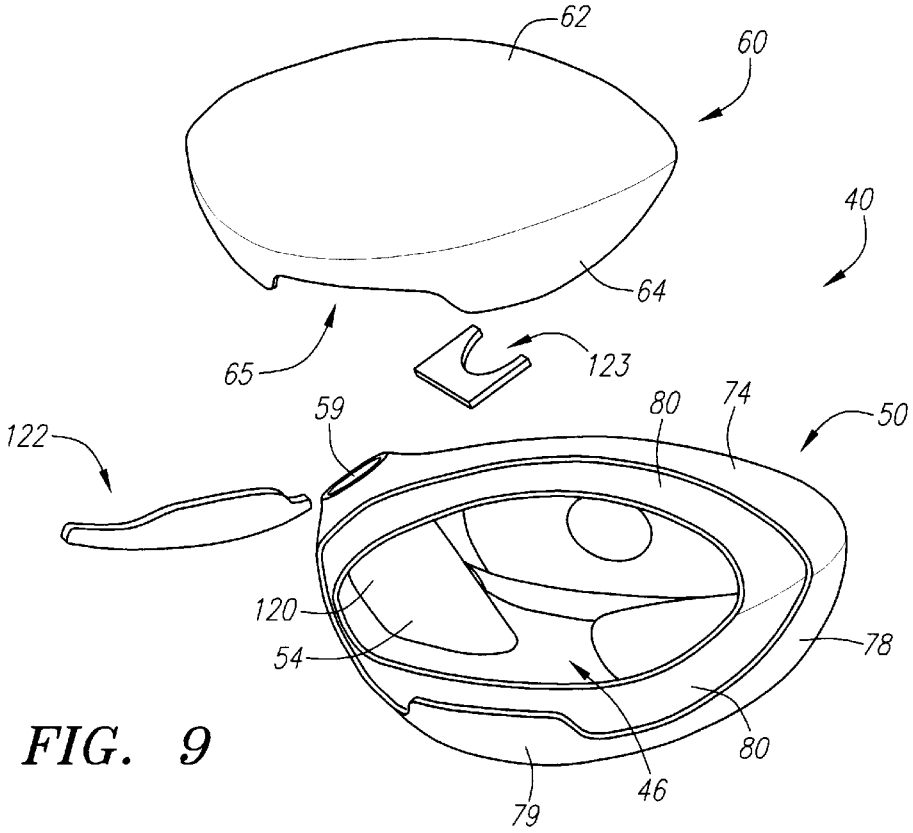
FIG. 9 is an exploded view of the components of the golf club head of the present invention.

FIG. 9 illustrates the hollow interior 46 of the club head 42 of the present invention. The hosel 54 is disposed within the hollow interior 46, and is preferably integral with the major body 50. The hosel 54 is preferably cast with the major body 50. Additionally, the hosel 54 may be composed of a non-similar material that is light weight and secured using bonding or other mechanical securing techniques. A hollow interior of the hosel 54 is defined by a hosel wall 120 that forms a tapering tube from the aperture 59 to the sole section 78. The shaft 48 is disposed within a hosel insert 121 that is disposed within the hosel 54. Such a hosel insert 121 and hosel 54 are described in U.S. Pat. No. 6,352,482, entitled Golf Club With Hosel Liner, which pertinent parts are hereby incorporated by reference.

As shown in FIG. 9, a rear weighting member 122 is preferably positioned within the hollow interior 46 of the club head 40. In a preferred embodiment, the rear weighting member 122 is disposed on the interior surface of the ribbon section 78 in order to increase the moment of inertia and control the center of gravity of the golf club head 40. A heel weighting member 123 is placed adjacent the hosel 54 on the interior surface of the sole section 76. However, those skilled in the pertinent art will recognize that additional weighting members may be placed in other locations of the club head 40 in order to influence the center of gravity, moment of inertia, or other inherent properties of the golf club head 40. The weighting members 122 and 123 are preferably weight chips thickened areas of the major body 50 or weight chips welded to the interior surface of the major body 50. Those skilled in the pertinent art will recognize that other high density materials may be utilized as an optional weighting member without departing from the scope and spirit of the present invention.

Figure 12:
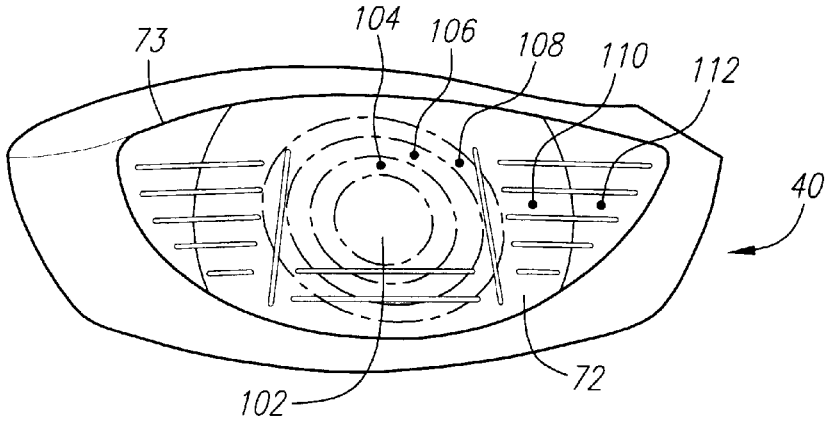
FIG. 12 is a front plane view of the golf club head of the present invention illustrating the variation in face thickness for one embodiment.

FIG. 12 illustrates the variation in the thickness of the striking plate section 72. The striking plate section 72 is preferably partitioned into elliptical regions, each having a different thickness. In a preferred embodiment for the striking plate section 72, the striking plate section 72 has an central elliptical region 102 which preferably has the greatest thickness that ranges from 0.120 inch to 0.100 inch, preferably from 0.115 inch to 0.105 inch, and is most preferably 0.111 inch. The central elliptical region 102 preferably has uniform thickness. A first concentric region 104 preferably has the next greatest thickness that ranges from 0.110 inch to 0.090 inch, preferably from 0.104 inch to 0.094 inch. The first concentric region 104 preferably transitions in thickness from 0.110 inch to 0.100 inch. A second concentric region 106 preferably has the next greatest thickness that ranges from 0.100 inch to 0.080 inch, preferably from 0.095 inch to 0.085 inch. The second concentric region 106 preferably transitions in thickness from 0.100 inch to 0.090 inch. A third concentric region 108 preferably has the next greatest thickness that ranges from 0.090 inch to 0.070 inch, preferably from 0.083 inch to 0.073 inch. The third concentric region 108 preferably transitions in thickness from 0.090 inch to 0.080 inch. A first periphery region 110 preferably has the next greatest thickness that ranges from 0.085 inch to 0.061 inch. The first periphery region 110 preferably transitions in thickness from 0.080 inch to 0.070 inch. A second periphery region 112 preferably has a uniform thickness that ranges from 0.050 inch to 0.080 inch, and most preferably 0.070 inch.

In an alternative embodiment, a central elliptical region 102 preferably has the greatest thickness that ranges from 0.120 inch to 0.100 inch, preferably from 0.115 inch to 0.105 inch, and is most preferably 0.111 inch. The central elliptical region 102 preferably has uniform thickness. A first concentric region 104 preferably has the next greatest thickness that ranges from 0.110 inch to 0.090 inch, preferably from 0.104 inch to 0.094 inch, and is most preferably 0.099 inch. A periphery region 110 preferably has the next greatest thickness that ranges from 0.069 inch to 0.061 inch. The variation in the thickness of the striking plate section 72 allows for the greatest thickness to be distributed in the center 111 of the striking plate section 72 thereby enhancing the flexibility of the striking plate section 72 which corresponds to less energy loss to a golf ball and a greater coefficient of restitution.

Preferably, the major body 50 is cast from molten metal in a method such as the well-known lost-wax casting method. The metal for casting is preferably 17-4 stainless steel. Additional methods for manufacturing the major body 50 include forming the major body 50 from a flat sheet of metal, super-plastic forming the major body 50 from a flat sheet of metal, machining the major body 50 from a solid block of metal, electrochemical milling the major body 50 from a forged pre-form, and like manufacturing methods. Yet further methods include diffusion bonding titanium or steel sheets to yield a variable face thickness face and then superplastic forming.

The present invention is directed at a golf club head that has a high coefficient of restitution thereby enabling for greater distance of a golf ball bit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The mass of the club head 40 of the present invention ranges from 165 grams to 250 grams, preferably ranges from 175 grams to 230 grams, and most preferably from 200 grams to 221 grams, with the three-wood golf club head 40 preferably having a mass of 203 grams and the eleven-wood golf club head 40 preferably having a mass of 221 grams. Preferably, the major body 50 has a mass ranging from 140 grams to 200 grams, more preferably ranging from 150 grams to 180 grams, yet more preferably from 155 grams to 166 grams, and most preferably 161 grams. The minor body 60 has a mass preferably ranging from 4 grams to 20 grams, more preferably from 5 grams to 15 grams, and most preferably 7 grams. The rear weighting member 122 has a mass preferably ranging from 10 grams to 50 grams, more preferably from 30 grams to 40 grams, and most preferably 31 grams. The heel weighting member 123 has a mass preferably ranging from 2 grams to 15 grams, more preferably from 3 grams to 10 grams, and most preferably 5 grams. Additionally, epoxy, or other like flowable materials, in an amount ranging from 0.5 grams to 5 grams, may be injected into the hollow interior 46 of the golf club head 40 for selective weighting thereof.

Figure 10:
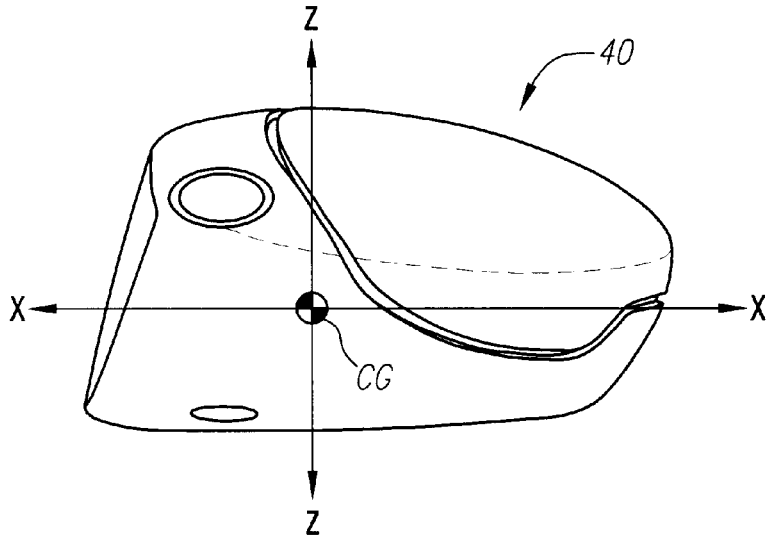
FIG. 10 is a heel side plan view of a golf club of the present invention illustrating the Z axis and X axis.
Figure 10A:
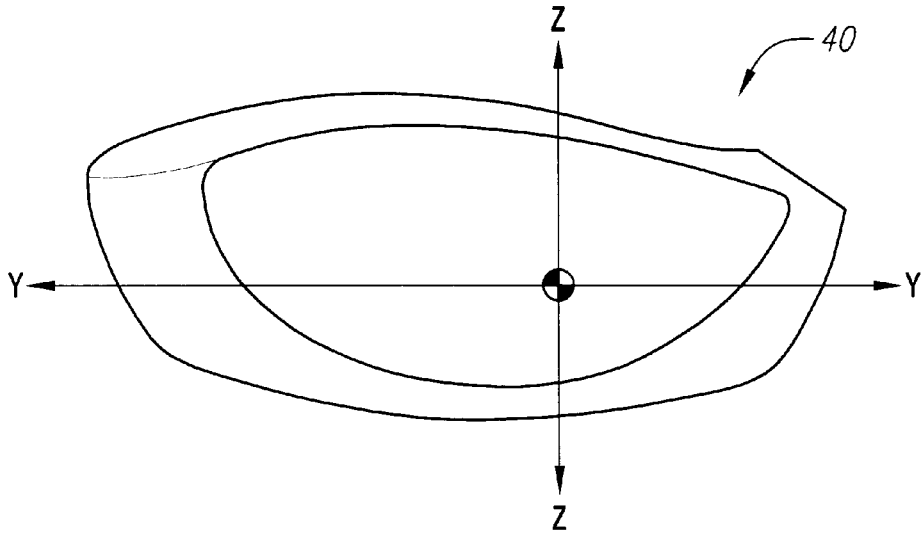
FIG. 10A is a front plan view of a golf club of the present invention illustrating the Z axis and Y axis.

FIGS. 10 and 10A illustrate the axes of inertia through the center of gravity of the golf club head. The axes of inertia are designated X, Y and Z. The X axis extends from the striking plate section 72 through the center of gravity, CG, and to the rear of the golf club head 40. The Y axis extends from the toe end 68 of the golf club head 40 through the center of gravity, CG, and to the heel end 66 of the golf club head 40. The Z axis extends from the crown section 62 through the center of gravity, CG, and to the sole section 76.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

Figure 11:
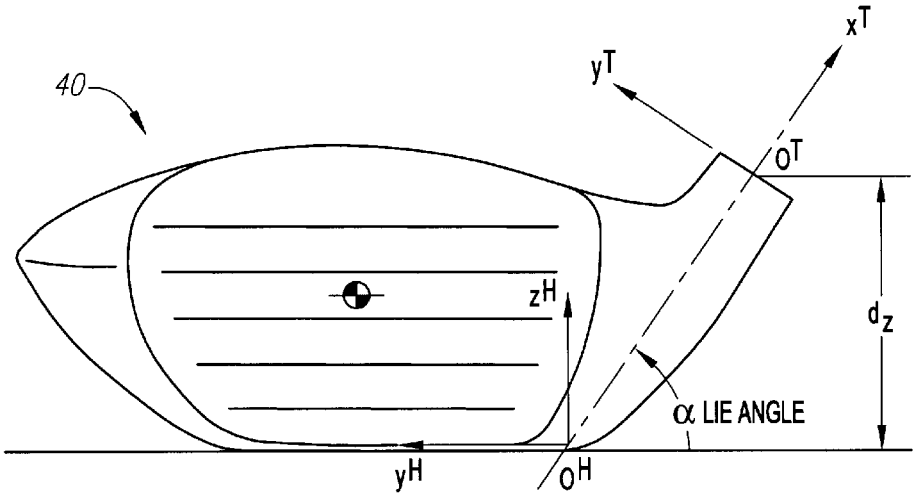
FIG. 11 is a front plan view of a golf club of the present invention illustrating the test frame coordinates $X^T$ and $Y^T$ and transformed head frame coordinates $Y^{H\ and\ ZH}$.
Figure 11A:
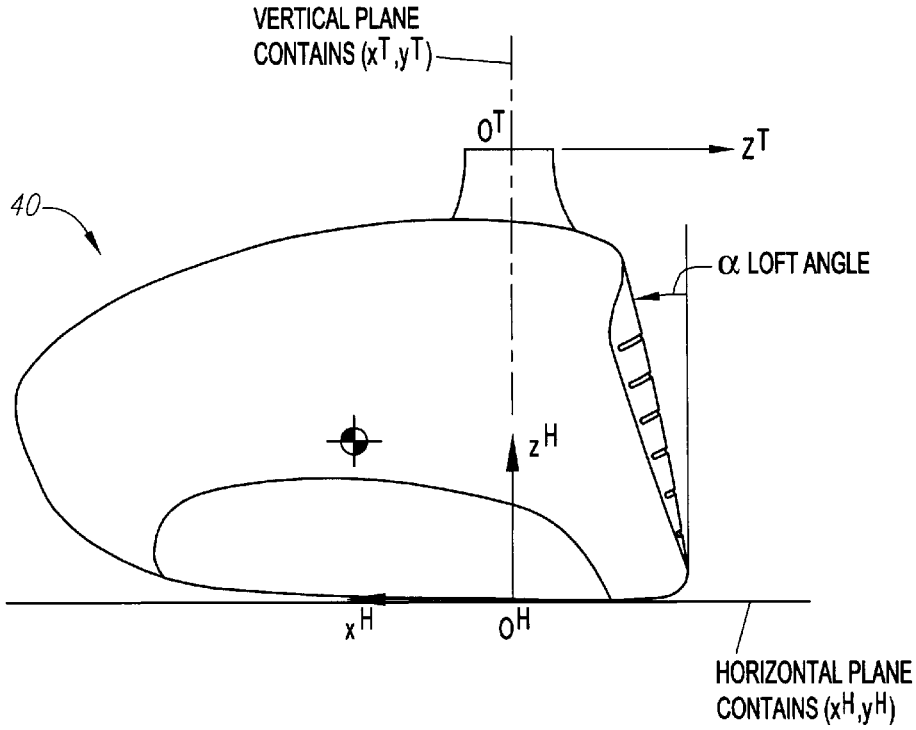
FIG. 11A is a toe end view of the golf club of the present invention illustrating the test frame coordinate $Z^T$ and transformed head frame coordinates $X^H$ and $Z^H$.

The center of gravity and the moment of inertia of a golf club head 40 are preferably measured using a test frame ($X^T$, $Y^T$, $Z^T$), and then transformed to a head frame ($X^H$, $Y^H$, $Z^H$), as shown in FIGS. 11 and 11A. The center of gravity of a golf club head may be obtained using a center of gravity table having two weight scales thereon, as disclosed in co-pending U.S. patent application Ser. No. 09/796,951, filed on Feb. 27, 2001, entitled High Moment Of Inertia Composite Golf Club, and hereby incorporated by reference in its entirety.

In general, the moment of inertia, Izz, about the Z axis for the golf club head 40 of the present invention will range from 1900 g-cm$^2$ to 3000 g-cm$^2$, preferably from 1990 g-cm$^2$ to 2500 g-cm$^2$, and most preferably from 1990 g-cm$^2$ to 2400 g-cm$^2$. The moment of inertia, Iyy, about the Y axis for the golf club head 42 of the present invention will range from 900 g-cm$^2$ to 1700 g-cm$^2$ preferably from 950 g-cm$^2$ to 1500 g-cm$^2$, and most preferably from 965 g-cm$^2$ to 1200 g-cm$^2$. Table One list the moments of inertia for a 3-wood golf club head 40, a 7-wood golf club head 40, 9-wood golf club head 40 and 11-wood golf club head 40.

TABLE ONE

| Club | Ixx | Iyy | Izz |
|---|---|---|---|
| 3 wood | 1937 | 1110 | 2392 |
| 7 wood | 1561 | 965 | 1995 |
| 9 wood | 1577 | 991 | 2034 |
| 11 wood | 1579 | 1001 | 2049 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf club head comprising:

a major body composed of a metal material, the major body having striking plate section, a return section, a sole section, a ribbon section and a ledge section, the striking plate section having a thickness in the range of 0.010 inch to 0.250 inch and the return section having a thickness ranging from 0.020 inch to 0.250 inch, the return section extending a distance ranging 0.25 inch to 1.5 inches from a perimeter of the striking plate section; and a minor body composed of a non-metal material, the minor body having a crown section and a ribbon section, the minor body attached to the ledge section of the major body.

2. The golf club head according to claim 1 wherein the striking plate section has a thickness in the range of 0.055 inch to 0.125 inch.

3. The golf club head according to claim 1 wherein the striking plate section has a thickness in the range of 0.060 inch to 0.111 inch.

4. The golf club head according to claim 1 wherein the minor body is composed of a plurality of plies of pre-preg material.

5. The golf club head according to claim 1 wherein the ledge section is inward a distance ranging from 0.005 inch to 0.020 inch from an exterior surface of the major body.

6. The golf club head according to claim 1 wherein the striking plate section has concentric regions of varying thickness with the thickest region in about the center.

7. The golf club head according to claim 1 wherein the striking plate section comprises a central elliptical region having a base thickness, a first concentric region having a first thickness wherein the base thickness is greater than the first thickness, a second concentric region having a second thickness wherein the first thickness is greater than the second thickness, a third concentric region having a third thickness wherein the second thickness is greater than the third thickness, and a periphery region having a fourth thickness wherein the fourth thickness is less than the third thickness.

8. The golf club head according to claim 1 wherein the return section has a thickness ranging from 0.050 inch to 0.150 inch.

9. The golf club head according to claim 1 wherein the golf club head has a volume ranging from 200 cubic centimeters to 300 cubic centimeters.

10. The golf club head according to claim 1 wherein the moment of inertia about the Izz axis of the golf club head ranges from 1900 grams-centimeter squared to 2400 grams-centimeter squared.

11. A golf club comprising:

a golf club head comprising a major body composed of a metal material, the major body having striking plate section, a return section, a sole section, a ribbon section and a ledge section, the striking plate section having a thickness in the range of 0.010 inch to 0.250 inch and the return section having a thickness ranging from 0.020 inch to 0.250 inch, the return section extending a distance ranging 0.25 inch to 1.5 inches from a perimeter of the striking plate section, arid a minor body composed of a non-metal material, the minor body having a crown section and a ribbon section, the minor body attached to the ledge section of the major body;

a shaft connected to the golf club head;

wherein the golf club has a loft angle greater than thirteen degrees;

wherein the moment of inertia about the Izz axis through the center of gravity ranges from 1900 to 2400 grams-centimeter squared, and the moment of inertia about the Iyy axis through the center of gravity ranges from 900 to 1400 grams-centimeter squared.

12. A golf club head comprising:

a major body composed of a cast stainless steel material, the major body having striking plate section, a return section, a sole section, a ribbon section and a ledge section, the striking plate section having a thickness in the range of 0.010 inch to 0.250 inch and the return section having a thickness ranging from 0.020 inch to 0.250 inch, the return section extending a distance ranging 0.25 inch to 1.5 inches from a perimeter of the striking plate section, the ledge section is inward a distance ranging from 0.005 inch to 0.020 inch from an exterior surface of the major body; and a minor body composed of a plurality of plies of pre-preg material, the minor body having a crown section and a ribbon section, the minor body attached to the ledge section of the major body with a liquid adhesive, the minor body having a thickness ranging from 0.010 inch to 0.070 inch;

wherein the moment of inertia about the Izz axis through the center of gravity ranges from 1904 to 2400 grams-centimeter squared, and the moment of inertia about the Iyy axis through the center of gravity ranges from 900 to 1400 grams-centimeter squared.

* * * * *